US009527099B2

(12) United States Patent
Huang

(10) Patent No.: US 9,527,099 B2
(45) Date of Patent: Dec. 27, 2016

(54) IMPINGEMENT SPRINKLER

(71) Applicant: Tzu-Lin Huang, Xianxi Township, Changhua County (TW)

(72) Inventor: Tzu-Lin Huang, Xianxi Township, Changhua County (TW)

( * ) Notice: Subject to any disclaimer, the term of this patent is extended or adjusted under 35 U.S.C. 154(b) by 0 days.

(21) Appl. No.: 14/941,920

(22) Filed: Nov. 16, 2015

(65) Prior Publication Data

US 2016/0067725 A1 Mar. 10, 2016

Related U.S. Application Data

(63) Continuation-in-part of application No. 13/548,520, filed on Jul. 13, 2012, now abandoned.

(51) Int. Cl.

| | |
|---|---|
| ***B05B 15/10*** | (2006.01) |
| ***B05B 15/06*** | (2006.01) |
| ***B05B 3/04*** | (2006.01) |

(52) U.S. Cl.

CPC ..... *B05B 15/066* (2013.01); *B05B 3/0477* (2013.01); *B05B 3/0481* (2013.01)

(58) Field of Classification Search

CPC ..... B05B 3/0454; B05B 3/0472; B05B 3/08; B05B 15/10; B05B 3/02; A01G 25/00

USPC ..... 239/232

See application file for complete search history.

(56) References Cited

U.S. PATENT DOCUMENTS

| | | | | |
|---|---|---|---|---|
| 3,350,015 | A * | 10/1967 | Friedmann | B05B 3/0481 239/230 |
| 3,744,720 | A * | 7/1973 | Meyer | B05B 3/0481 188/72.1 |
| 4,164,324 | A | 8/1979 | Bruninga | |
| 4,193,548 | A * | 3/1980 | Meyer | B05B 3/003 239/230 |
| 4,231,522 | A * | 11/1980 | Drechsel | B05B 3/003 188/166 |
| 4,669,663 | A * | 6/1987 | Meyer | B05B 3/0477 239/252 |
| 4,813,605 | A * | 3/1989 | Fuller | B05B 3/16 239/233 |
| 4,907,742 | A | 3/1990 | Whitehead et al. | |
| 5,209,404 | A | 5/1993 | Jun | |
| 5,353,989 | A | 10/1994 | Dreschsel | |
| 5,476,223 | A | 12/1995 | Dreschsel | |
| 2010/0270398 | A1 | 10/2010 | Wang | |
| 2012/0241539 | A1 | 9/2012 | Wang | |

* cited by examiner

*Primary Examiner* — Arthur O Hall
*Assistant Examiner* — Chee-Chong Lee
(74) *Attorney, Agent, or Firm* — Egbert Law Offices, PLLC

(57) ABSTRACT

An impingement sprinkler includes a main frame, a sprinkling device laterally pivotally mounted onto the main frame, an impinging device rotatably mounted on the sprinkling device, a reversing device disposed on the sprinkling device and a limit device is mounted to a lower portion of the main frame, wherein the limit device is operated with reversing device to limit the horizontally rotary angle and accurately control the irrigating area of the impingement sprinkler

1 Claim, 10 Drawing Sheets

IMPINGEMENT SPRINKLER

CROSS-REFERENCE TO RELATED U.S. APPLICATIONS

This application is a Continuation-In-Part of application Ser. No. 13/548,520, filed on Jul. 13, 2012, and entitled "IMPINGEMENT SPRINKLER", presently pending.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to an impingement sprinkler, and more particularly to an innovative one which is used to limit the poke rod in the limiting ring frame so as to enable steering of the impingement sprinkler 2. Description of Related Art Including Information Disclosed Under 37 CFR 1.97 and 37 CFR 1.98.

Impingement sprinklers are extensively used for gardening irrigation and spraying, since circulating or reciprocating water sprinkling of the impingement sprinklers can be realized in an annular zone. In order to further improve its practicability, a tilting impingement sprinkler has been developed, allowing to adjust the outlet angle by tilting upwards or downwards (i.e. when tilting upwards, the parabolic sprinkling distance is bigger, or otherwise smaller) so as to meet the users' diversified demands. The present invention is intended to improve the steering structure of this tilting impingement sprinkler A conventional impingement sprinkler generally comprises: a main body, a water tubing portion located at bottom of the main body, a swing frame installed on the main body, a steering structure and a tilting rotational structure. Of which, the steering structure generally comprises of two rotatable limiting baffles set externally on the water tubing portion and a poke rod located on one side of main body and extended downwards between two limiting baffles. When the main body is driven to rotate by the swing frame, the poke rod is also driven to abut onto a limiting baffle, allowing the poke rod to swing and link the internal members for the steering of the main body. However, the conventional poke rod is located between two limiting baffles, and the periphery of which is designed into an open state due to lack of any limiting structure. So, when the main body is tilted upwards, the poke rod will be located beyond the limiting baffle and disengaged from abutting state, this will lead to loss of main body' steering function, failure of rotary sprinkling and unbalanced sprinkling, thus significantly reducing its convenience and practicability.

Thus, to overcome the aforementioned problems of the prior art, it would be an advancement if the art to provide an improved structure that could significantly improve the efficacy.

Therefore, the inventor has provided the present invention of practicability after deliberate design and evaluation based on years of experience in the production, development and design of related products.

BRIEF SUMMARY OF THE INVENTION

The main objective of the present invention is to provide an improved impingement sprinkler that has a poke rod always limited within a limiting ring so as to enable steering of the impingement sprinkler.

To achieve the objective, the impingement sprinkler in accordance with the present invention comprises a main frame, a sprinkling device laterally pivotally mounted onto the main frame, an impinging device rotatably mounted on the sprinkling device, a reversing device disposed on the sprinkling device and a limit device is mounted to a lower portion of the main frame, wherein the limit device is operated with reversing device to limit the horizontally rotary angle and accurately control the irrigating area of the impingement sprinkler.

The main frame includes a tubular structure downward extending therefrom and a first pivot seat formed on a top thereof. A first path is defined in the tubular structure and extends into the first pivot seat. A tube is sleeved on the tubular structure, wherein the tube is rotatable and movable relative to the tubular structure. A threaded portion is formed on a lower portion of the tube and adapted to be screwed into a pipe.

The sprinkling device is formed with a second pivot seat laterally rotatably mounted onto the first pivot seat such that the sprinkling device is vertically adjustable relative to the main frame to adjust a sprinkling elevation of the sprinkling device relative to a moving plane of the main frame. The sprinkling device includes a sprinkling head mounted thereon and a second path defined therein, wherein the second path extends to the sprinkling head and communicates with the first path.

The impinging device includes a impinging element rotatably mounted on the sprinkling device, and a torsion spring disposed between the impinging element and the sprinkling device such that the impinging element is reciprocally rotated and intermittently impinges the sprinkling device for steering the sprinkling device when the sprinkling device continually sprinkles water through the sprinkling head. The impinging element includes an actuator downward extending therefrom.

The reversing device includes a first clutch and a second clutch sequentially pivotally mounted onto the sprinkling device, wherein the first clutch and the second clutch are opposite to each other. The first clutch includes a connecting rod downward extending from a middle portion thereof and the second clutch includes a hook formed on a free end of the second clutch, wherein a poke rod is pivotally connected to the connecting rod and the poke rod is freely swung relative to the connecting rod.

The limiting device includes a limiting ring co-axially and horizontally mounted onto the tube for preventing the poke rod from being overly radially moved relative to the tube, wherein the limiting ring is rotatable relative to the tube, the poke rod inwardly extending through the limiting ring such that the limiting ring limits a free end of the poke rod moved within the limiting ring when the sprinkling device is rotated relative to the main frame for adjusting the outflow angle of the sprinkling device. The limiting device includes an adjusting rod pivotally and radially connected to the tube. The limiting ring is radially formed with a limiting rod, wherein the limiting rod and the adjusting rod define a sectorial area and an angle. One end of the limiting rod is formed with a first C-shaped holder engaged to the tube and one end of the adjusting rod is formed with a second C-shaped holder engaged to the tube such that the relative position of the limiting rod and the adjusting rod is adjustable, and the sectorial area, the angle and the irrigating area of the impingement sprinkler are adjustable.

Further benefits and advantages of the present invention will become apparent after a careful reading of the detailed description with appropriate reference to the accompanying drawings.

DETAILED DESCRIPTION OF THE INVENTION

Figure 1:
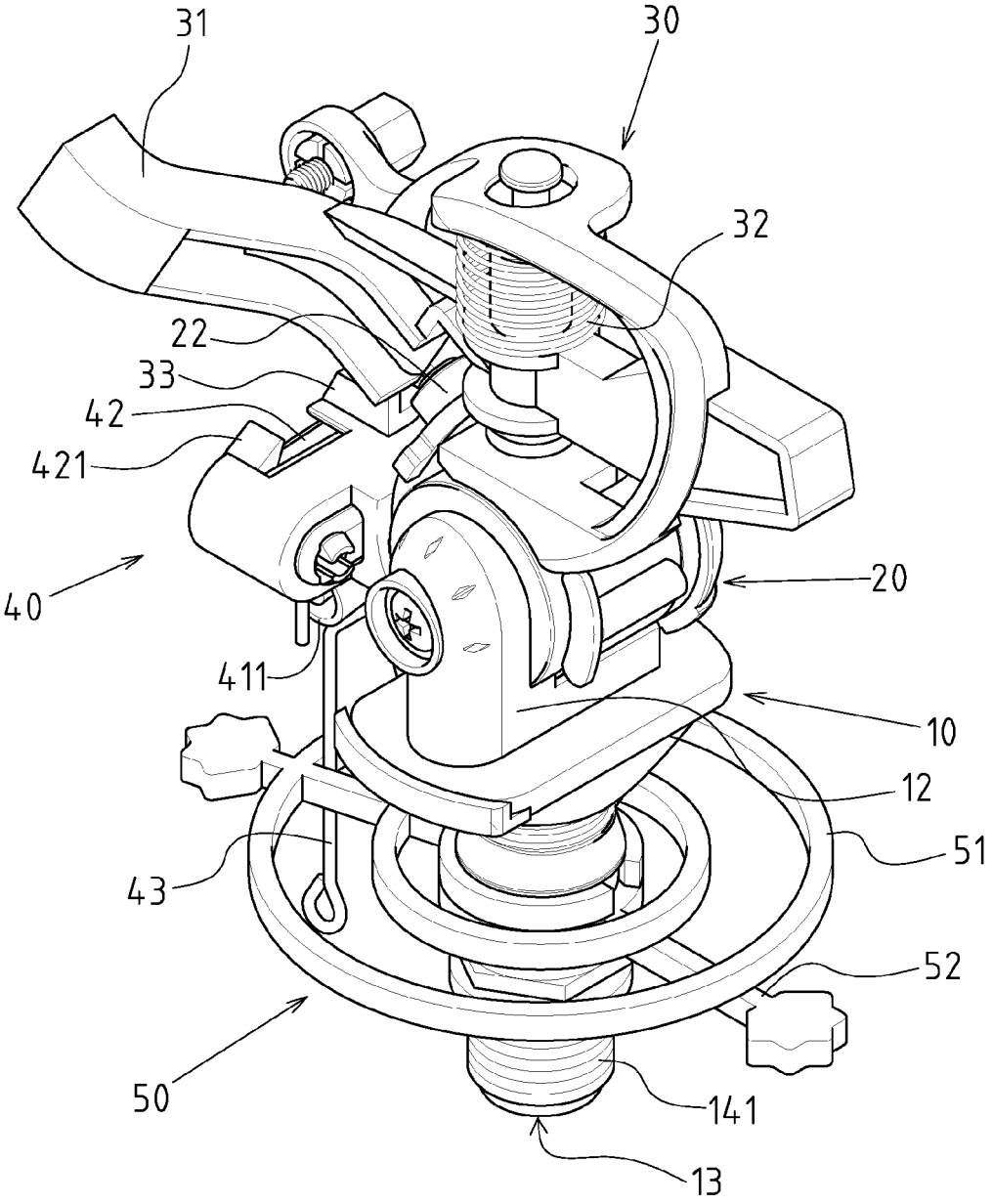
FIG. 1 is a perspective view of an impingement sprinkler in accordance with the present invention.
Figure 2:
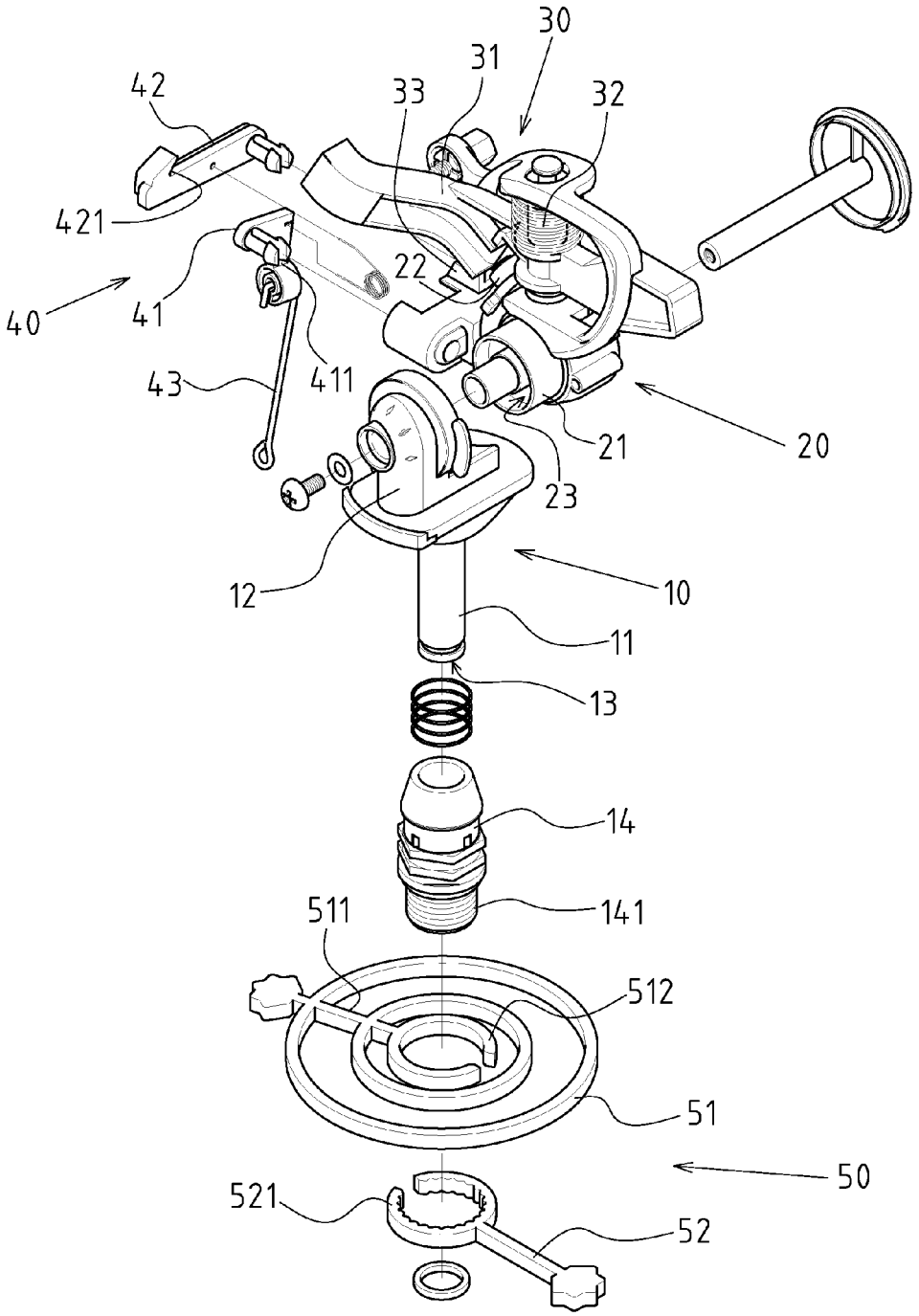
FIG. 2 is an exploded perspective view of the impingement sprinkler in FIG. 1.
Figure 3:
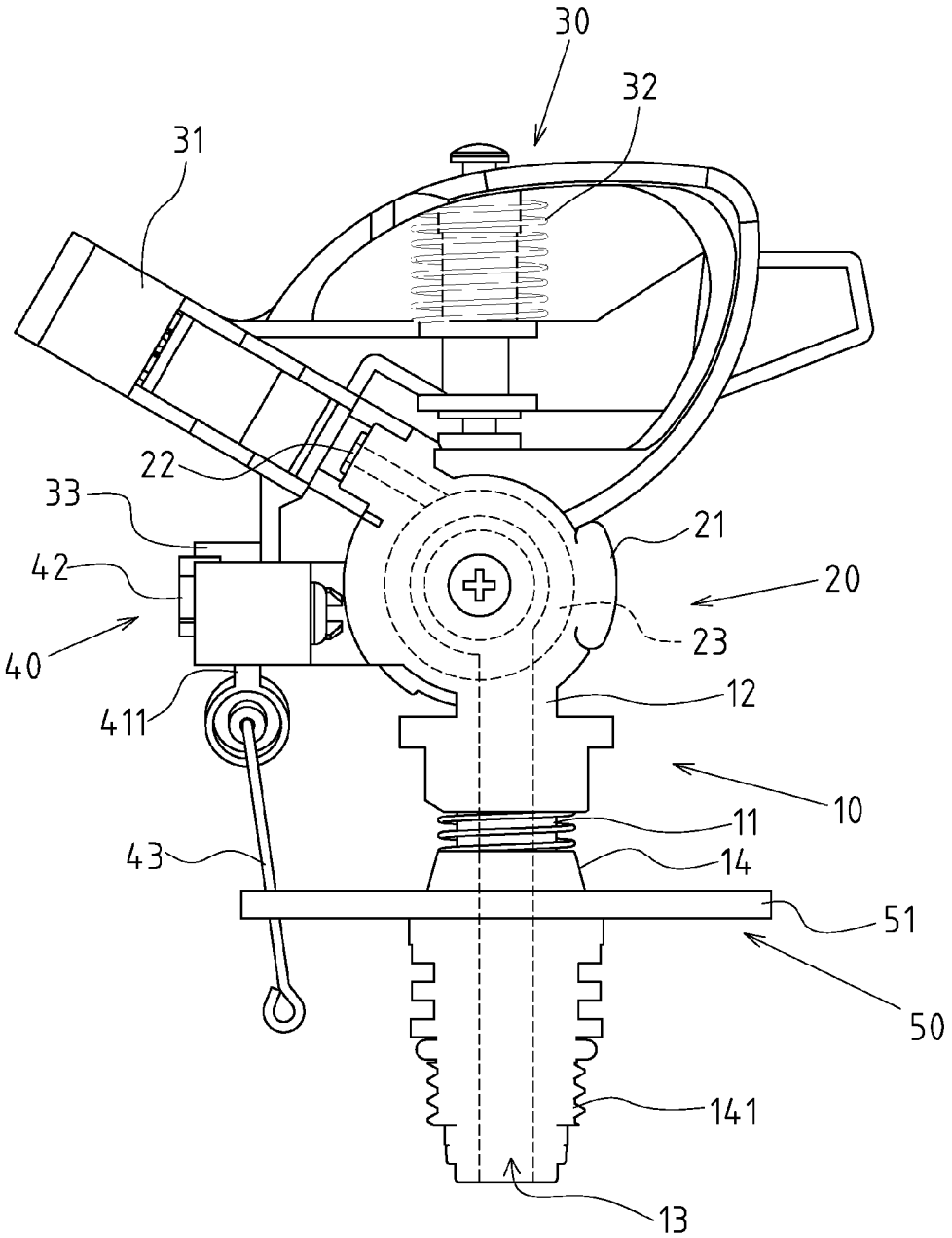
FIG. 3 is a side plan view of the impingement sprinkler in accordance with the present invention for showing the paths therein.

Referring to the drawings and initially to FIGS. 1-5, an impingement sprinkler in accordance with the present invention comprises a main frame 10, a sprinkling device 20 laterally pivotally mounted onto the main frame 10, an impinging device 30 rotatably mounted on the sprinkling device 20, a reversing device 40 disposed on the sprinkling device 20 and a limit device 50 is mounted to a lower portion of the main frame 10. The limit device 50 is operated with reversing device 40 to limit the horizontally rotary angle and accurately control the irrigating area of the impingement sprinkler in accordance with the present invention.

The main frame 10 includes a tubular structure 11 downward extending therefrom and a first pivot seat 12 formed on a top thereof. A first path 13 is defined in the tubular structure 11 and extends into the first pivot seat 12. A tube 14 is sleeved on the tubular structure 11, wherein the tube 14 is rotatable and movable relative to the tubular structure 11. A threaded portion 141 is formed on a lower portion of the tube 14. The threaded portion is 141 adapted to be screwed into a pipe (not shown).

The sprinkling device 20 is formed with a second pivot seat 21. The second pivot seat 21 is laterally rotatably mounted onto the first pivot seat 12 such that the sprinkling device 20 is vertically adjustable relative to the main frame 10 to adjust a sprinkling elevation of the sprinkling device 20 relative to a moving plane of the main frame 10. The sprinkling device 20 includes a sprinkling head 22 mounted thereon and a second path 23 defined therein, wherein the second path 23 extends to the sprinkling head 22 and communicates with the first path 13.

The impinging device 30 includes a impinging element 31 rotatably mounted on the sprinkling device 20, and a torsion spring 32 disposed between the impinging element 31 and the sprinkling device 20 such that the impinging element 31 is reciprocally rotated and intermittently impinges the sprinkling device 20 for steering the sprinkling device 20 when the sprinkling device 20 continually sprinkles water through the sprinkling head 22. The impinging element 31 includes an actuator 33 downward extending therefrom.

The reversing device 40 includes a first clutch 41 and a second clutch 42 sequentially pivotally mounted onto the sprinkling device 20, wherein the first clutch 41 and the second clutch 42 are opposite to each other. The first clutch 41 includes a connecting rod 411 downward extending from a middle portion thereof and the second clutch 42 includes a hook 421 formed on a free end of the second clutch 42, wherein a poke rod 43 is pivotally connected to the connecting rod 411 and the poke rod 43 is freely swung relative to the connecting rod 411.

The limiting device 50 includes a limiting ring 51 coaxially and horizontally mounted onto the tube 14 for preventing the poke rod 43 from being overly radially moved relative to the tube 14, wherein the limiting ring 51 is rotatable relative to the tube 14. The poke rod 43 inwardly extends through the limiting ring 51 such that the limiting ring 51 limits a free end of the poke rod 43 moved within the limiting ring 51 when the sprinkling device 20 is rotated relative to the main frame 10 for adjusting the outflow angle of the sprinkling device 20. The limiting device 50 includes an adjusting rod 52 pivotally and radially connected to the tube 14. The limiting ring 51 is radially formed with a limiting rod 511, wherein the limiting rod 511 and the adjusting rod 52 define a sectorial area A and an angle O. One end of the limiting rod 511 is formed with a first C-shaped holder 512 engaged to the tube 14 and one end of the adjusting rod 52 is formed with a second C-shaped holder 521 engaged to the tube 14 such that the relative position of the limiting rod 511 and the adjusting rod 52 is adjustable. Accordingly, the sectorial area A, the angle 0 and the irrigating area of the impingement sprinkler are adjustable.

Figure 5:
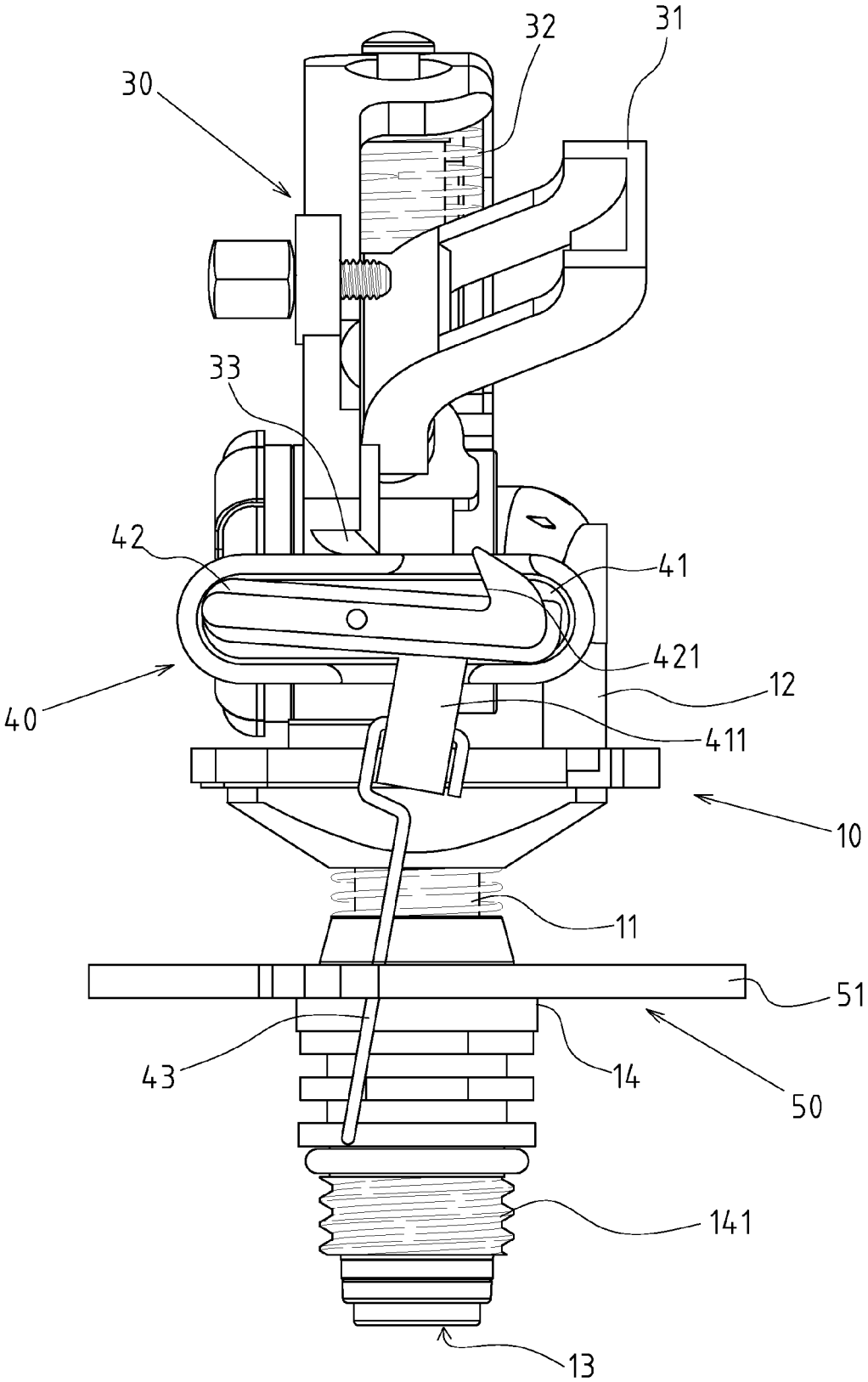
FIG. 5 is a front plan view of the impingement sprinkler when steering clockwise.
Figure 6:
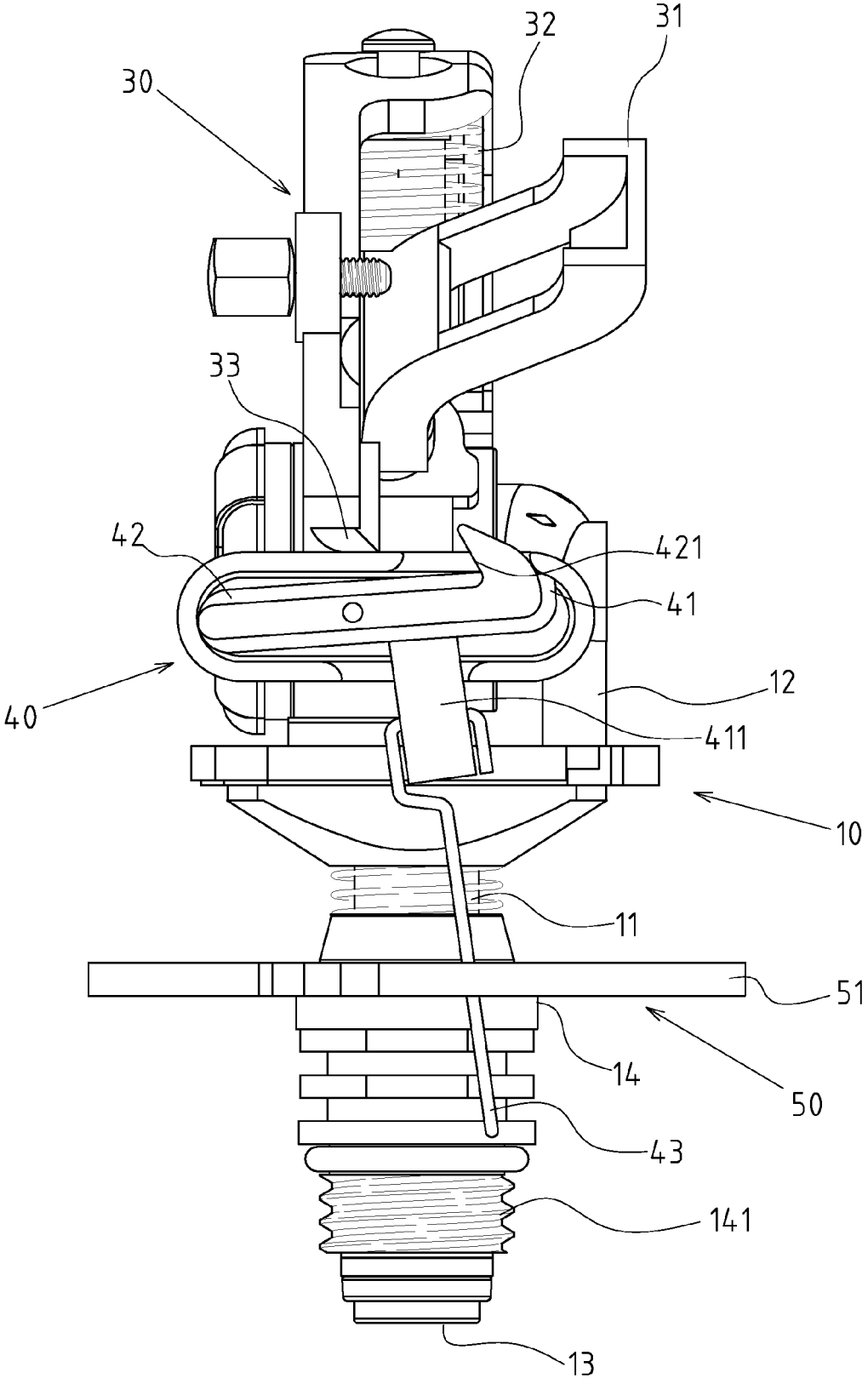
FIG. 6 is a front plan view of the impingement sprinkler when steering counter-clockwise.
Figure 7:
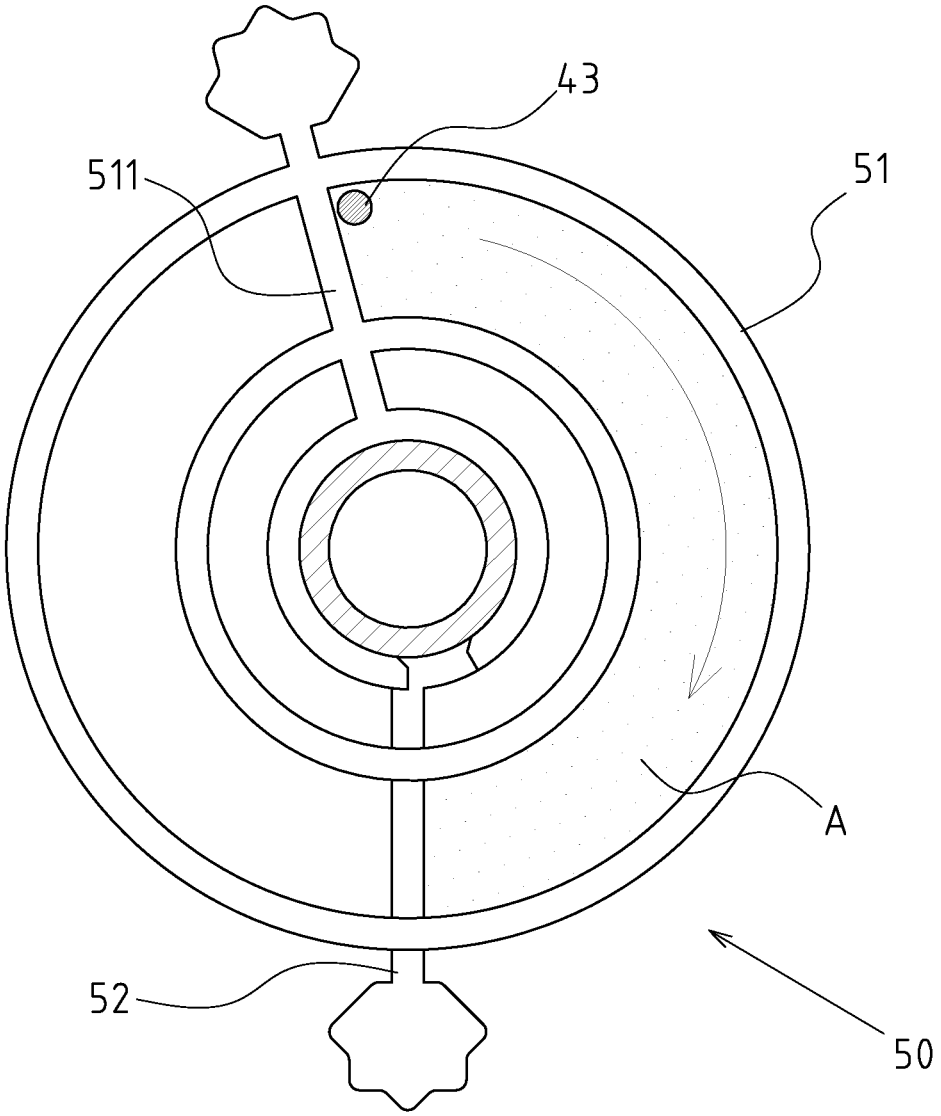
FIGS. 7 and 8 are operational views of the limit device and the poke rod of the impingement sprinkler in accordance with the present invention.
Figure 8:
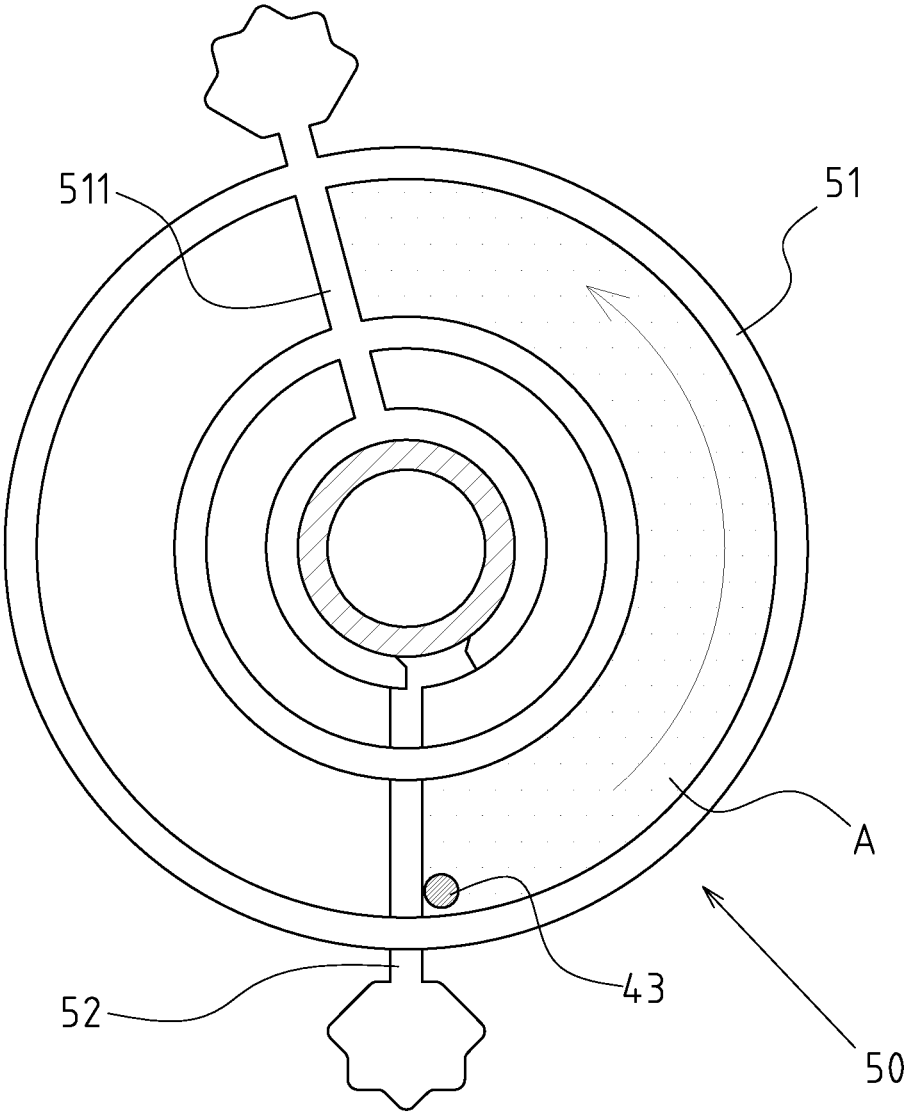

With reference to FIGS. 5 and 7, the free end of the second clutch 42 is downward moved when the poke rod 43 contacts with the limiting rod 511 due to the rotating main frame 10. As a result, the backward impinging element 31 directly impinges the sprinkling device 20 and the sprinkling device 20 is rotated along the arrow as shown FIG. 7. With reference to FIGS. 6 and 8, the free end of the second clutch 42 is upwardly moved when the poke rod 43 contacts with the adjusting rod 52 due to the rotating main frame 10. As a result, the actuator 33 directly impinges the hook 421 on the second clutch 42 and the sprinkling device 20 is rotated along the arrow as shown FIG. 8. Consequently, the sprinkling device 20 reciprocally irrigates the sectorial area A according to the angle θ defined by the limiting rod 511 and the adjusting rod 52 when the sprinkling device 20 continually sprinkling Accordingly, the sectorial area A is adjusted when the relative position between the limiting rod 511 and the adjusting rod 52 is adjusted for effectively using water resource.

Figure 4:
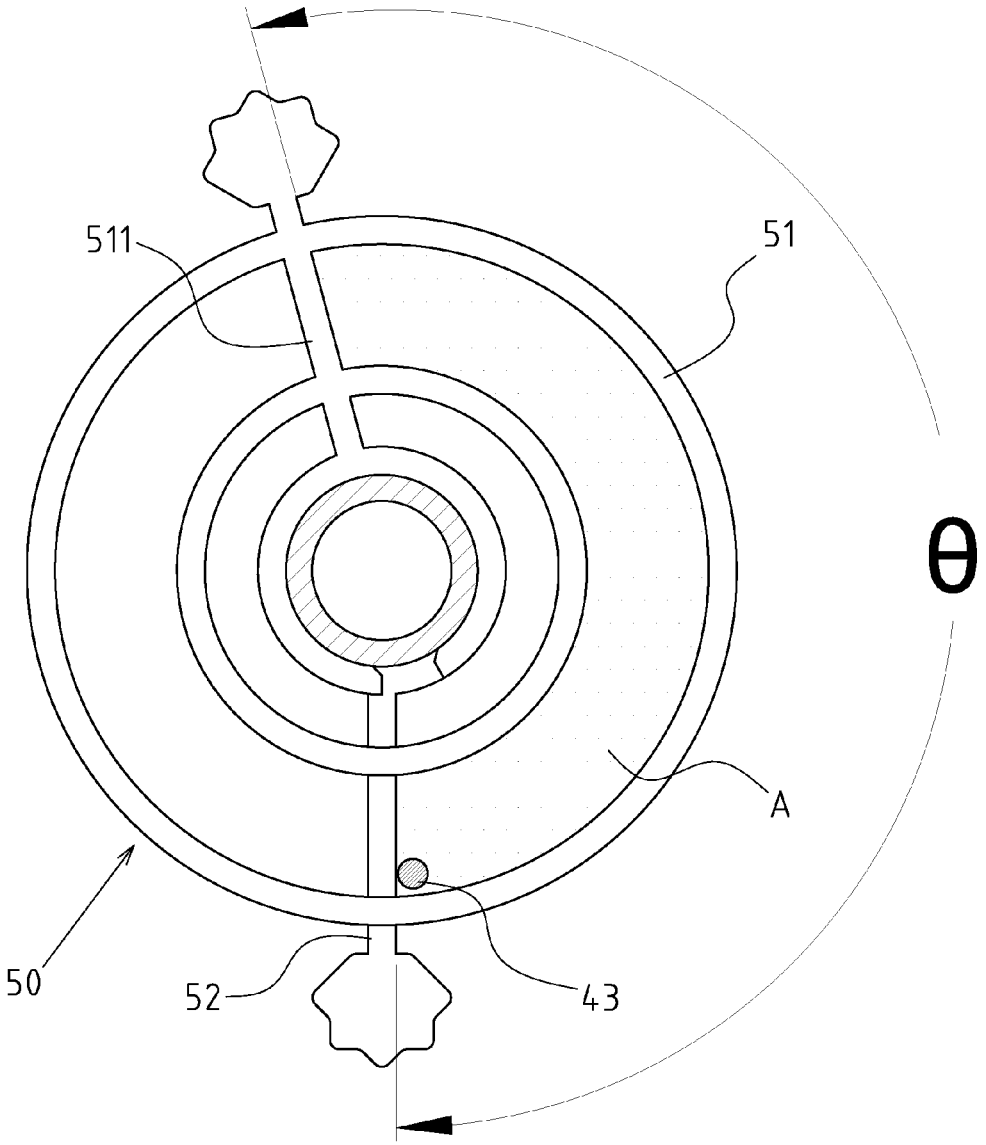
FIG. 4 is a top plan view of a limit device of the impingement sprinkler in accordance with the present invention for showing the operational angle.
Figure 9:
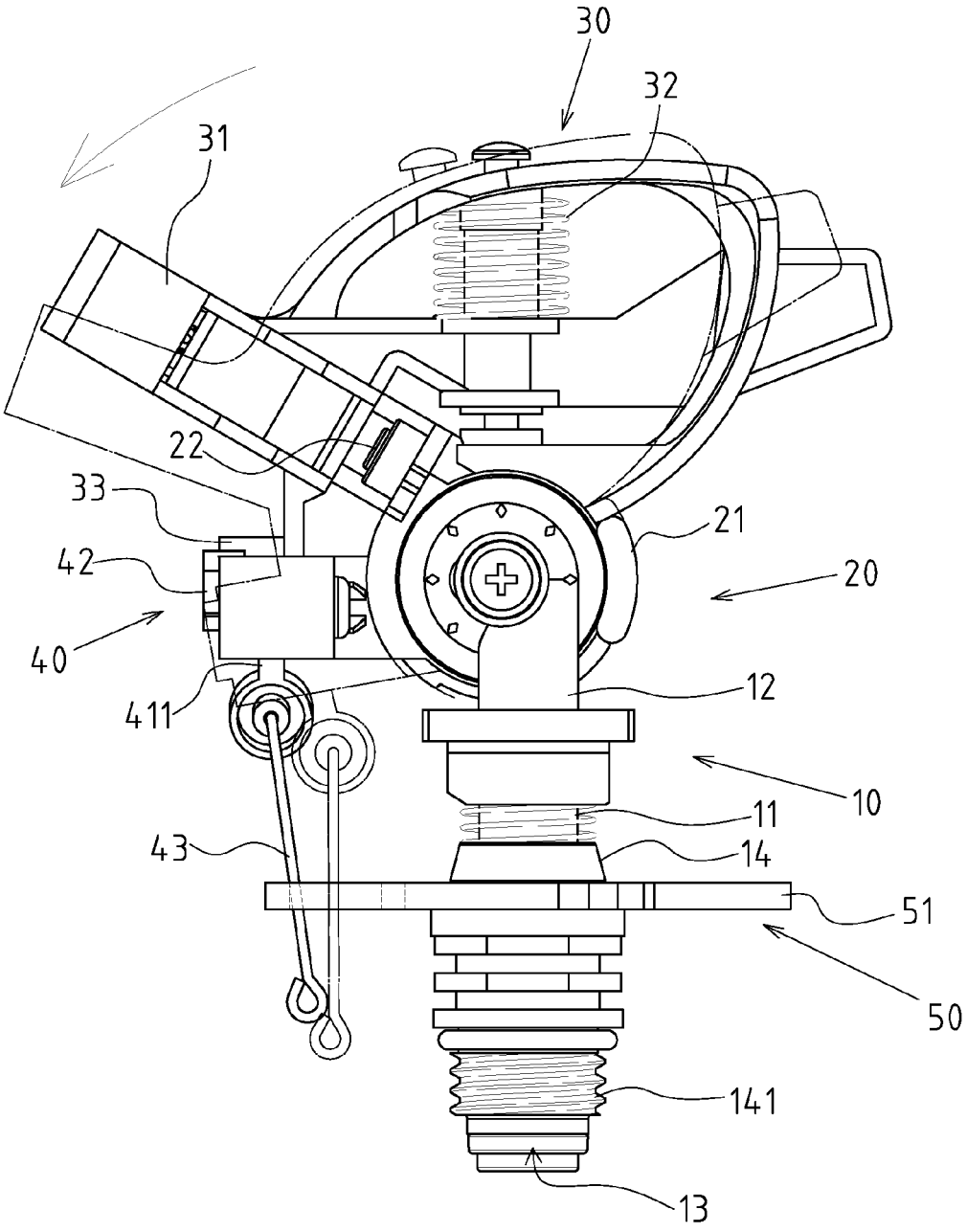
FIGS. 9 and 10 are operational views of the impingement sprinkler in accordance with the present invention when the sprinkling angle of the sprinkling device is adjusted relative to the main frame.
Figure 10:
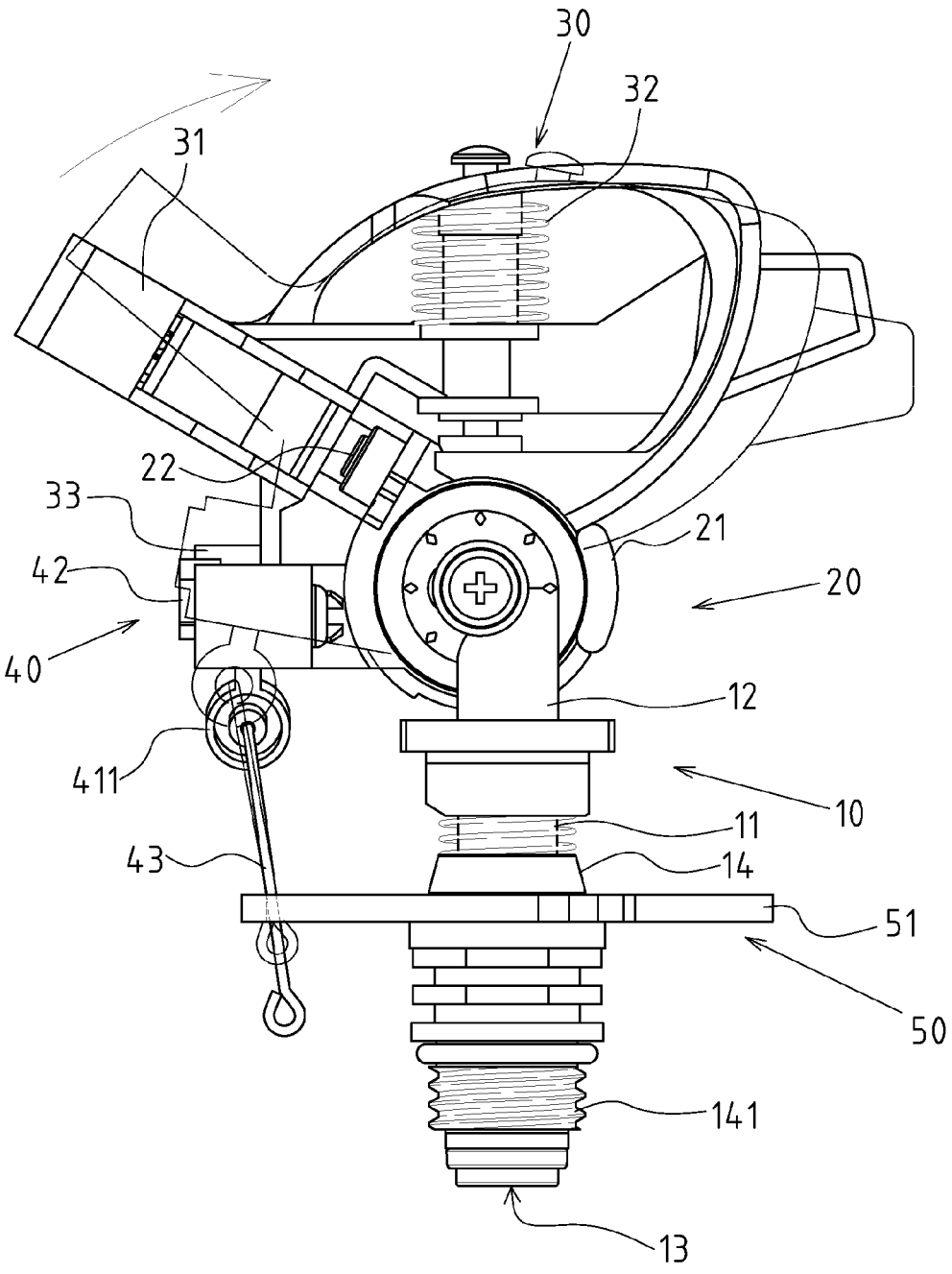

With reference to FIG. 9, the free end of the connecting rod 411 is moved toward the tube 14 and the poke rod 43 is located in the sectorial area A defined by the limiting rod 511 and the adjusting rod 52 when the sprinkling device 20 is downward rotated relative to the main frame 10. Consequently, the first clutch 41 and the second clutch 42 of the reversing device 40 change their phases in time and the sprinkling device 20 reciprocally irrigates within the angle θ. With reference to FIG. 10, the free end of the of the connecting rod 411 is outwardly moved when the sprinkling device 20 is rotated relative to the main frame 10 and the sprinkling head 22 is raised. With reference to FIGS. 4, 7 and 8, the limiting ring 51 is used to limit the poke rod 43 and prevents the free end of the free poke rod 43 from escaping from the sectorial area A defined by the limiting rod 511 and the adjusting rod 52. The reversing device 40 is useless and the impingement sprinkler irrigates an annular area when the free end of the free poke rod 43 from escapes from the sectorial area A defined by the limiting rod 511 and the adjusting rod 52. The water is wasted when the operator only needs a sectorial irrigating area. In addition, the poke rod 43 may be seriously swung and moved over the limiting rod 511/adjusting rod 52 when the impinging element 31 impinges the main frame 10. As a result, the impingement sprinkler irrigates an opposite sectorial area that is useless. However, the limiting ring 511 can effectively limit the poke rod 43 to ensure that the impingement sprinkler irrigates the purposed sectorial area A with the angle θ defined by the limiting rod 511 and the adjusting rod 52.

Although the invention has been explained in relation to its preferred embodiment, it is to be understood that many other possible modifications and variations can be made without departing from the spirit and scope of the invention as hereinafter claimed.

I claim:

1. An impingement sprinkler comprising a main frame, a sprinkling device laterally pivotally mounted onto the main frame, an impinging device rotatably mounted on the sprinkling device, a reversing device disposed on the sprinkling device and a limit device is mounted to a lower portion of the main frame, wherein the limit device is operated with reversing device to limit the horizontally rotary angle and accurately control the irrigating area of the impingement sprinkler;

the main frame including a tubular structure downward extending therefrom and a first pivot seat formed on a top thereof, a first path defined in the tubular structure and extending into the first pivot seat, a tube sleeved on the tubular structure, wherein the tube is rotatable and movable relative to the tubular structure, a threaded portion formed on a lower portion of the tube and adapted to be screwed into a pipe;

the sprinkling device formed with a second pivot seat laterally rotatably mounted onto the first pivot seat such that the sprinkling device is vertically adjustable relative to the main frame to adjust a sprinkling elevation of the sprinkling device relative to a moving plane of the main frame, the sprinkling device including a sprinkling head mounted thereon and a second path defined therein, wherein the second path extends to the sprinkling head and communicates with the first path;

the impinging device including a impinging element rotatably mounted on the sprinkling device, and a torsion spring disposed between the impinging element and the sprinkling device such that the impinging element is reciprocally rotated and intermittently impinges the sprinkling device for steering the sprinkling device when the sprinkling device continually sprinkles water through the sprinkling head, the impinging element including an actuator downward extending therefrom;

the reversing device including a first clutch and a second clutch sequentially pivotally mounted onto the sprinkling device, wherein the first clutch and the second clutch are opposite to each other, the first clutch including a connecting rod downward extending from a middle portion thereof and the second clutch including a hook formed on a free end of the second clutch, wherein a poke rod is pivotally connected to the connecting rod and the poke rod is freely swung relative to the connecting rod; and the limiting device including a limiting ring co-axially and horizontally mounted onto the tube for preventing the poke rod from being overly radially moved relative to the tube, wherein the limiting ring is rotatable relative to the tube, the poke rod inwardly extending through the limiting ring such that the limiting ring limits a free end of the poke rod moved within the limiting ring when the sprinkling device is rotated relative to the main frame for adjusting the outflow angle of the sprinkling device, the limiting device including an adjusting rod pivotally and radially connected to the tube, the limiting ring radially formed with a limiting rod, wherein the limiting rod and the adjusting rod define a sectorial area and an angle, one end of the limiting rod formed with a first C-shaped holder engaged to the tube and one end of the adjusting rod formed with a second C-shaped holder engaged to the tube such that the relative position of the limiting rod and the adjusting rod is adjustable, and the sectorial area, the angle and the irrigating area of the impingement sprinkler are adjustable.

* * * * *